US007306405B2

(12) United States Patent
Schmidmaier et al.

(10) Patent No.: US 7,306,405 B2
(45) Date of Patent: Dec. 11, 2007

(54) BORING APPLIANCE

(75) Inventors: Ludwig Schmidmaier, Pegnitz (DE); Wolfgang Harttig, Gröbenzell (DE)

(73) Assignee: Bauer Maschinen GmbH, Schrobenhausen (DE)

( * ) Notice: Subject to any disclaimer, the term of this patent is extended or adjusted under 35 U.S.C. 154(b) by 118 days.

(21) Appl. No.: 10/642,156

(22) Filed: Aug. 18, 2003

(65) Prior Publication Data

US 2004/0037652 A1 Feb. 26, 2004

(30) Foreign Application Priority Data

Aug. 21, 2002 (DE) ..... 102 38 193

(51) Int. Cl.
*E02D 5/34* (2006.01)

(52) U.S. Cl. ..... 405/241; 405/256

(58) Field of Classification Search ..... 405/240, 405/231, 241, 256, 242, 233
See application file for complete search history.

(56) References Cited

U.S. PATENT DOCUMENTS

| | | | | |
|---|---|---|---|---|
| 3,255,592 | A | 6/1966 | Moor | |
| 3,645,343 | A * | 2/1972 | Mays | 173/195 |
| 3,682,575 | A * | 8/1972 | Guddal et al. | 417/517 |
| 4,397,588 | A * | 8/1983 | Goughnour | 405/236 |
| 4,428,677 | A * | 1/1984 | Schreiter, Jr. | 366/41 |
| 4,433,943 | A * | 2/1984 | Pao Chen | 405/241 |
| 4,846,580 | A * | 7/1989 | Oury | 366/27 |
| 5,256,005 | A * | 10/1993 | Beck, III | 405/240 |
| 5,512,325 | A * | 4/1996 | Langenohl et al. | 427/427 |
| 5,551,519 | A * | 9/1996 | Pach | 173/184 |
| 5,697,733 | A * | 12/1997 | Marsh, Jr. | 405/233 |
| 5,967,700 | A | 10/1999 | Gunther | |
| 6,048,137 | A | 4/2000 | Beck, III | |
| 6,116,819 | A * | 9/2000 | England | 405/241 |
| 6,485,234 | B2 * | 11/2002 | Johnson | 405/233 |
| 2003/0123937 | A1 * | 7/2003 | Landau | 405/233 |

FOREIGN PATENT DOCUMENTS

| | | | |
|---|---|---|---|
| JP | 5 603 1928 | A | 3/1981 |
| JP | 06264434 | A * | 9/1994 |

* cited by examiner

*Primary Examiner*—David Bagnell
*Assistant Examiner*—Daniel P Stephenson
(74) *Attorney, Agent, or Firm*—Jacobson Holman PLLC

(57) ABSTRACT

The invention relates to a boring appliance for producing a concrete element in the ground with a vehicle on which are located a tower, a concrete pump and a boring tool, which is installed for introduction in the ground at the tower. By means of a concrete pump and a delivery line concrete is pumped into a cavity formed by the boring tool for forming the concrete element. According to the invention, the concrete pump is detachably held on the rear region of the vehicle, which is opposite a front area with the tower.

34 Claims, 2 Drawing Sheets

BORING APPLIANCE

BACKGROUND OF THE INVENTION (1) Field of the Invention

The invention relates to a boring appliance for producing a concrete element in the ground with a vehicle.

A boring appliance of this type is known from JP 56 031 928 A, in which in addition to the boring tool a complete preparation and mixing installation for concrete are placed on a carriage.

(2) Description of Related Art

In the case of loose soil, in ground water or for concrete piles, which are to be produced in displaceable soils, preferably the following production procedures are used:

- boring methods using continuous, long soil augers,
- displacement boring methods, in which essentially long tubes are turned or rammed into the ground, the cropping out ground being displaced to the side,
- methods in which long soil augers are surrounded with a rotary encasing tube and both the auger and the tube are simultaneously introduced into the ground.

Such methods are essentially based on the same concreting procedure. After the augers or enveloped augers or displacement tubes have been brought to the final depth, the tube and/or auger is retracted and during retraction concrete is pumped into the resulting space or cavity through inside or soil-sided openings in the auger or tube. The introduction of concrete preferably takes place under a low pressure to ensure that no soil from the borehole wall can pass into the cavity.

The use of pumpcrete has a positive effect on the production rate of such piles.

According to the prior art, such as is e.g. known from U.S. Pat. No. 3,255,592, the concreting of such piles takes place in that at the outside or air-sided end of the boring tool, i.e. either at the outside end of the continuous auger or at the outside end of the displacement tubes, a concreting hose is fixed and leads to a concrete pump which is supplied by mobile or travelling mixers. As the concreting head at the end of the concreting auger or tube is constantly moved up and down, it is not recommended that working takes place with a freely hanging hose. During each pump impact the hose is struck and swings through the air. This can easily lead to damage and constitutes a hazard for personnel.

Thus, generally mobile concrete pumps with adjustable distributing masts or towers are chosen. This procedure is practicable in principle, but suffers from the disadvantage that throughout the pile production time it is necessary to have at the building site and expensive concrete pump with adjustable distributing mast, including driver, although the actual concreting process only lasts for a short time.

To economize on the driver, constructions are known such as from U.S. Pat. No. 6,048,137, in which a stationary concrete pump is installed at the building site and from there hoses are laid up to the concreting head on the boring appliance. Since as a result of the rapid operation the boring appliance covers considerable distances, relatively long hoses are used, which in the case of considerable heat suffers from the disadvantage that in such long hoses frequently blockages occur due to overheating. A further risk is that such hoses can be damaged during the movement of the boring appliance. The generally concrete-filled hoses are heavy and are therefore difficult for the site personnel to handle during the movement of the boring appliance. It must constantly be ensured that the hoses are not bent or that the tracked travelling gear does not pass over the hoses.

As a result of the pressure surges of the plunger or piston pumps the hose on the ground scrapes on the substrate, which leads to damage to the hose casing or jacket.

U.S. Pat. No. 5,967,700 discloses a boring appliance with pressure containers on the top of a superstructure from which pulverulent materials or water are injectable directly into the borehole for producing concrete therein.

BRIEF SUMMARY OF THE INVENTION

The object of the invention is to provide a boring appliance, which is usable in a particularly mobile and flexible manner at building sites for producing concrete posts in the ground and which has a simple construction.

According to the invention this object is achieved by a boring appliance for producing a concrete element in the ground with a vehicle on which are located a tower, a concrete pump and a boring tool, which is installed for introduction into the around at tower and by means of the concrete pump and a delivery line concrete can be pumped into a cavity formed by the boring tool for forming the concrete element, characterized in that the concrete pump is detachably held in the vehicle rear region, which faces a front area with the tower.

In one preferred embodiment, the drive of the concrete pump takes place by means of a hydraulic pump unit with its own drive additionally fitted to the vehicle and/or that the drive of the concrete pump takes place by means of the vehicle's own hydraulic pumps.

In another preferred embodiment, on the vehicle, preferably on the side facing the tower, a water tank is provided.

In another preferred embodiment, the concrete pump is detachably connected to the vehicle by means of a holding device.

In another preferred embodiment, from a transfer point firmly fixed to the tower, a movable hose line can passes to the concreting head at the outside end of the boring tool.

In another preferred embodiment, the concrete pump is a single or multiple plunger pump, a hose pump, a screw pump or an eccentric screw pump.

In another preferred embodiment, the concrete pump is hydraulically driven.

In another preferred embodiment, the boring tool is a simple soil auger, a soil auger with rotary encasing tubes or a displacement boring tool.

In another preferred embodiment, the concrete pump has a feed hopper.

In another preferred embodiment, the vehicle has a superstructure rotatable with respect to a chain or track unit and that the concrete pump is suspended on the superstructure.

In another preferred embodiment, to facilitate concrete filling, the concrete pump is located in an area close to the ground and offset with respect to the superstructure.

The special nature of the appliance according to the invention is that in the vicinity of the counterweight of a vehicle is fixed a concrete pump from which a fixed line leads to the boring appliance tower. The fixing of the concrete pump to the boring appliance avoids problems with the hose line and makes unnecessary the use of a concrete pump with an adjustable distributing tower.

DETAILED DESCRIPTION OF THE INVENTION

Figure 1:
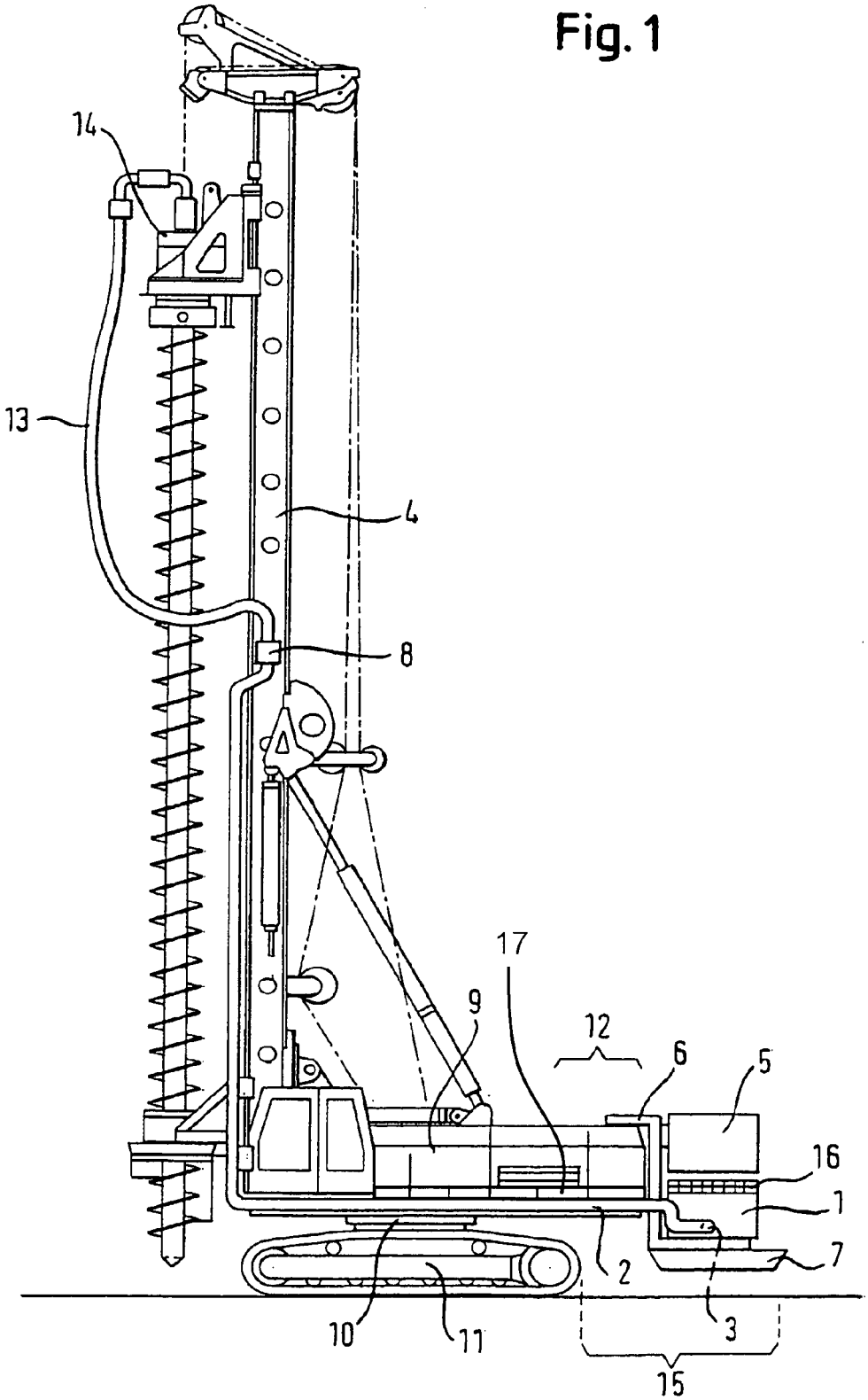
FIG. 1 is an elevational view of a boring appliance in accordance with the present invention.
Figure 2:
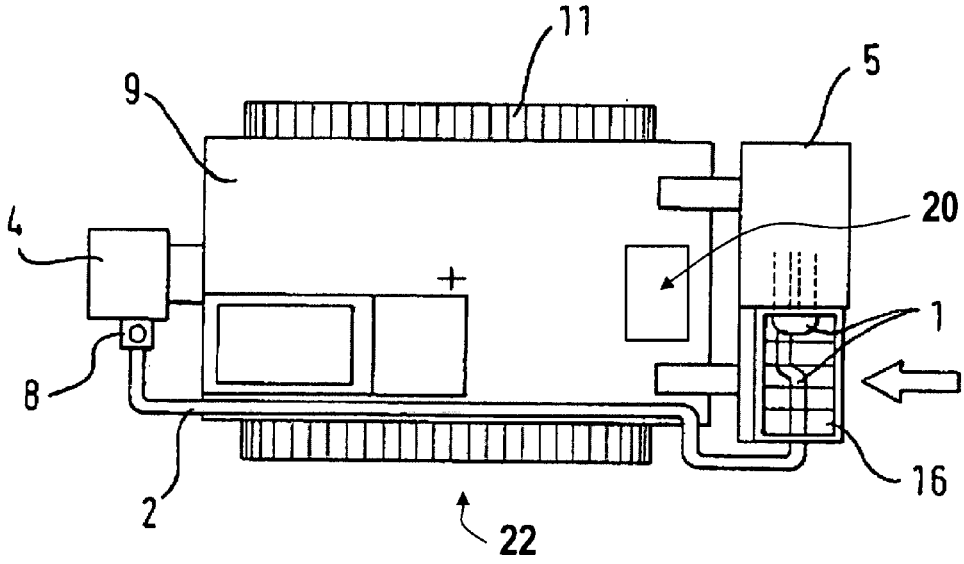
FIG. 2 is a plan view of a first embodiment of the boring appliance of FIG. 1.
Figure 3:
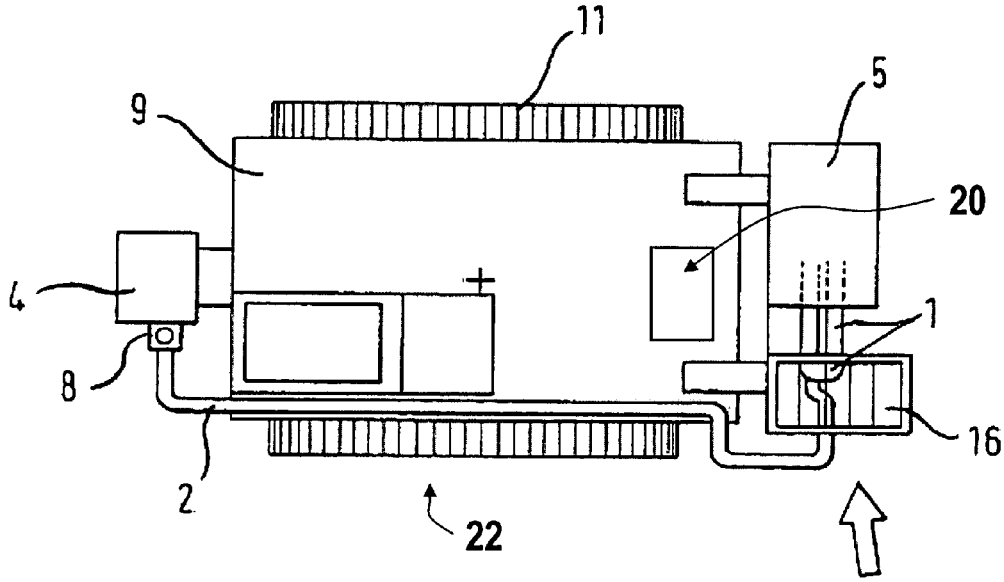
FIG. 3 is a plan view of a second embodiment of the boring appliance of FIG. 1.

The invention is explained in greater detail relative to FIGS. 1 to 3.

FIG. 1 shows an embodiment with a boring appliance in which the bored piles are produced according to the boring method using a continuous soil auger. After introducing the auger to the final depth of the pile to be produced, on retracting the auger concrete is introduced into the resulting cavity in the ground. For this purpose the concrete pump 1 with feed or filling hopper 16, which is fixed to the rear or tail of the superstructure 9 in the vicinity of the counterweight 20 of a vehicle 22, is supplied with concrete from a mobile mixer. The concrete is delivered by means of a concrete delivery line 2 to a fixed transfer point 8 on the tower 4 of the boring appliance. From said fixed transfer point 8, further transport takes place by means of a movable hose line 13 to concreting head 14, which is fixed to the outside end of the auger. This movable hose line 13 makes it possible for the drive to be moved up and down with the concreting head 14.

In the embodiment shown the concrete pump 1 has a separate drive unit 5 in the form of a hydraulic pump unit.

The concrete pump 1 is fixed with a mounting support 6 in detachable manner to the rear of the superstructure 9.

By means of a turntable 10 the superstructure 9 is connected to the chain or track unit 11. The concrete pump 1 is fixed so far away from the chains or tracks that the boring appliance can be rotated entirely around the chain or track unit 11 without the concrete pump 1 scraping thereon.

In addition to the concrete pump 1 a water storage tank 7 is located at the rear of the superstructure 9.

FIG. 2 is a systematic plan view of an inventive embodiment in which the feeding of the filling hopper 16 of concrete pump 1 takes place from the rear.

FIG. 3 is a systematic plan view of an inventive embodiment, where the feeding of the filling hopper 16 of concrete pump 1 takes place from the side.

The arrangement of the concrete pump 1 in the rear area 12 of the superstructure 9 has the following advantages. With respect to the heavy tower 1 with boring drive and boring tool, it constitutes an additional counterweight and consequently improves the stability of the boring appliance. This is particularly useful if the continuous soil auger is difficult to pull during concreting and consequently high tensile forces are activated. A further advantage is that from the outlet port 3 of the concrete pump 1 a substantially fixed laid concrete delivery line 2 is led up to a transfer point 8 fixed to the tower. This has the advantage that during the movement of the boring appliance or in the case of a boring process there is no risk for the concreting line between the concrete pump and the concreting head 14. The concrete delivery line 2 is short, cannot bend and is not damaged by the tracked travelling gear on moving to the next boring starting point. The concrete delivery line 2 carries out essentially the same movements as the superstructure 9 on turning or moving.

Further advantages of this substantially fixed laid line 2 is that the concrete delivery line can be protected against increased solar radiation and therefore heating by the fitting of sun protection plates or separate cooling devices 17. A premature hardening of the concrete in the line can consequently be prevented.

Another advantage of the appliance combination according to the invention is that there is no need for separate operating personnel for the concrete pump 1. Due to the fact that the concrete pump 1 is in the immediate vicinity of the excavator driver, it is possible for the latter to monitor the filling process during concreting. The excavator driver can directly contact the concrete delivery vehicle driver.

A further advantage is the shortness of the concrete delivery lines between the concrete pump and transfer point 8. As a result of the lower jacket friction losses in the pipe cross-section more and faster pumping is possible.

The substantially linearly laid concrete delivery lines 2 along the superstructure 9 and tower 4 lead to reduced resistance during concrete pumping and reduce the blockage susceptibility. In addition, the substantially linear connections can largely be in steel pipe form, which reduces friction during concrete delivery as compared with rubber hoses.

Numerous constructional variants are possible for the concrete pump 1. Preferably, for pumping the concrete, use is made of plunger pumps with relatively long plunger strokes. The plungers are driven by means of hydraulic cylinders. The necessary oil quantity per time unit and the pressure are produced by means of hydraulic pump units.

Another variant is constituted by hose pumps, where the concrete delivery essentially takes place in that the concrete is moved forwards by squeezing elastic hoses within the hose line. If excessive feed pressures are not required, it is also possible to use screw pumps or eccentric screw pumps.

The driving of the concrete pumps 1 generally takes place through an additional hydraulic pump unit 5, which provides the necessary oil quantities and oil pressures. However, since during the concreting process the full capacity of the oil hydraulics of the vehicle or excavator is not used, it can be appropriate not to have an additional hydraulic pump unit 5 and instead use the vehicle hydraulics. This economizes on fuel and the technical costs are reduced.

The fixing of the concrete pump 1 generally takes place in such a way that the filling hopper 16 of concrete pump 1 can be easily supplied from the concrete mixing vehicles. Due to the fact that the fixing of the concrete pump takes place on the tower-remote side of the superstructure 9, fixing can occur in such a way that the pump 1 with its feed hopper 16 is only just above the cropping out ground. In this case the distance must be chosen in such a way that on turning the superstructure 9, the pump structure does not stick on the chain or track unit 11 with its track travelling gear.

To increase the independence of the concrete pump system on the excavator, it is appropriate to provide a water tank 7 on the rear of the superstructure 9. As on building sites a stationary water supply cannot always be ensured, a water tank is necessary for cleaning the concrete pump 1 during concreting pauses. The water tank 7 located in the rear region 12 also offers the advantage of an additional weight at the rear, which improves the stability of the overall boring appliance system.

The discharge hopper used for supplying the concrete pump 1 can be arranged laterally at the rear of the superstructure 9 in the manner shown in FIG. 1 and then the truck mixers can move up to the boring appliance at right angles to the superstructure longitudinal axis.

In a further variant the filling opening of the concrete pump 1 is positioned in such a way that it is directed towards the extended rear of the superstructure 9. FIG. 2 is a systematic plan view of an inventive embodiment, in which the filling hopper 16 of the concrete pump 1 is supplied from the rear.

As the emptying of the mobile mixer takes place all the more easily the lower the opening of the filling hopper 16 for the concrete pump 1, the preferred area for locating the concrete pump 1 is area 15. Area 15 is fixed in such a way that it does not come into contact with the tracks or chains of the bogie 11 on pivoting the superstructure 9. In principle, a ground clearance of the pump is only a few decimetres in order to compensate unevennesses of the terrain.

In the sense of the above-described invention concrete is to be generally looked upon as a filling product, which is usable for the production of foundation, sealing and stabilizing elements.

The invention claimed is:

1. Boring appliance for producing a concrete element in the ground comprising:

a vehicle having a front area and a rear region opposite the front area, a tower located on the vehicle at the front area, a water tank located on the vehicle, a counterweight located on the vehicle in the vehicle rear region, a concrete pump detachably held in the vehicle rear region, the concrete pump being located in the vicinity of the counterweight and constituting an additional counterweight with respect to the tower for improving the stability of the boring appliance, holding means detachably connecting the concrete pump to the vehicle, a boring tool installed for introduction into the ground at the tower, for forming a cavity, wherein the boring tool is a simple soil auger, a soil auger with rotary encasing tubes, or a displacement boring tool, a delivery line, through which concrete from the concrete pump can be pumped into the cavity formed by the boring tool for forming the concrete element, and means provided on the vehicle in the vicinity of the delivery line for preventing premature hardening of the concrete in the delivery line due to increased solar radiation.

2. Boring appliance according to claim 1, wherein the water tank is located in the rear region of the vehicle.

3. Boring appliance according to claim 1, further comprising a concreting head at the air-sided end of the boring tool and a movable hose line passing to the concreting head from a transfer point firmly fixed to the tower.

4. Boring appliance according to claim 1, wherein the concrete pump is a single or multiple plunger pump, a hose pump, a screw pump or an eccentric screw pump.

5. Boring appliance according to claim 1, wherein the concrete pump is hydraulically driven.

6. Boring appliance according to claim 1, wherein the concrete pump has a feed hopper.

7. Boring appliance according to claim 1, wherein the vehicle has a superstructure rotatable with respect to a chain or track unit and the concrete pump is suspended on the superstructure.

8. Boring appliance according to claim 7, wherein to facilitate concrete filling, the concrete pump is located in an area close to the ground and offset with respect to the superstructure.

9. Boring appliance according to claim 7, further comprising concrete pumping means for pumping concrete from the concrete pump into the cavity formed by the boring tool for forming the concrete element, wherein the concrete pumping means is a delivery line that is short between the concrete pump and a transfer point fixed to the tower, cannot bend, and is positioned so as not to be damaged by the chain or track unit on moving to a next boring sight, whereby the delivery line carries out essentially the same movements as the superstructure on turning or moving.

10. Boring appliance according to claim 7, further comprising concrete pumping means for pumping concrete from the concrete pump into the cavity formed by the boring tool for forming the concrete element, wherein the concrete pumping means is a laid line and is substantially linear along the superstructure and the tower.

11. Boring appliance according to claim 10, wherein the substantially linear laid line is largely in the form of steel pipe.

12. Boring appliance according to claim 1, further comprising a hydraulic pump unit with its own drive additionally fitted to the vehicle and wherein the drive of the concrete pump takes place by means of the hydraulic pump unit.

13. Boring appliance according to claim 12, wherein the vehicle includes hydraulic pumps, and wherein the drive of the concrete pump takes place by means of the vehicle's hydraulic pumps.

14. Boring appliance according to claim 1, wherein the vehicle includes hydraulic pumps, and wherein the drive of the concrete pump takes place by means of the vehicle's hydraulic pumps.

15. Boring appliance according to claim 1, further comprising concrete pumping means for pumping concrete from the concrete pump into the cavity formed by the boring tool for forming the concrete element, wherein the concrete pump has an outlet port, the concrete pumping means is a laid, substantially fixed delivery line, and from the outlet port, the delivery line is led up to a transfer point fixed to the tower.

16. Boring appliance according to claim 1, wherein the means for preventing premature hardening of the concrete in the delivery line comprises sun protection plates fitted to the delivery line.

17. Boring appliance according to claim 1, wherein the means for preventing premature hardening of the concrete in the delivery line comprises separate cooling devices fitted to the delivery line.

18. Boring appliance for producing a concrete element in the ground comprising:

a vehicle having a front area and a rear region opposite the front area, a tower located on the vehicle at the front area, a water tank located on the vehicle, a concrete pump detachably held in the vehicle rear region, holding means detachably connecting the concrete pump to the vehicle, a boring tool installed for introduction into the ground at the tower, for forming a cavity, wherein the boring tool is a simple soil auger, a soil auger with rotary encasing tubes, or a displacement boring tool, a delivery line, through which concrete from the concrete pump can be pumped into the cavity formed by the boring tool for forming the concrete element, and means provided on the vehicle in the vicinity of the delivery line for preventing premature hardening of the concrete in the delivery line due to increased solar radiation.

19. Boring appliance according to claim 18, wherein the water tank is located in the rear region of the vehicle.

20. Boring appliance according to claim 18, further comprising a concreting head at the air-sided end of the boring tool and a movable hose line passing to the concreting head from a transfer point firmly fixed to the tower.

21. Boring appliance according to claim 18, wherein the concrete pump is a single or multiple plunger pump, a hose pump, a screw pump or an eccentric screw pump.

22. Boring appliance according to claim 18, wherein the concrete pump is hydraulically driven.

23. Boring appliance according to claim 18, wherein the concrete pump has a feed hopper.

24. Boring appliance according to claim 18, wherein the vehicle has a superstructure rotatable with respect to a chain or track unit and the concrete pump is suspended on the superstructure.

25. Boring appliance according to claim 24, wherein to facilitate concrete filling, the concrete pump is located in an area close to the ground and offset with respect to the superstructure.

26. Boring appliance according to claim 24, further comprising concrete pumping means for pumping concrete from the concrete pump into the cavity formed by the boring tool for forming the concrete element, wherein the concrete pumping means is a delivery line that is short between the concrete pump and a transfer point fixed to the tower, cannot bend, and is positioned so as not to be damaged by the chain or track unit on moving to a next boring sight, whereby the delivery line carries out essentially the same movements as the superstructure on turning or moving.

27. Boring appliance according to claim 24, further comprising concrete pumping means for pumping concrete from the concrete pump into the cavity formed by the boring tool for forming the concrete element, wherein the concrete pumping means is a laid line and is substantially linear along the superstructure and the tower.

28. Boring appliance according to claim 27, wherein the substantially linear laid line is largely in the form of steel pipe.

29. Boring appliance according to claim 18, further comprising a hydraulic pump unit with its own drive additionally fitted to the vehicle and wherein the drive of the concrete pump takes place by means of the hydraulic pump unit.

30. Boring appliance according to claim 29, wherein the vehicle includes hydraulic pumps, and wherein the drive of the concrete pump takes place by means of the vehicle's hydraulic pumps.

31. Boring appliance according to claim 18, wherein the vehicle includes hydraulic pumps, and wherein the drive of the concrete pump takes place by means of the vehicle's hydraulic pumps.

32. Boring appliance according to claim 18, further comprising concrete pumping means for pumping concrete from the concrete pump into the cavity formed by the boring tool for forming the concrete element, wherein the concrete pump has an outlet port, the concrete pumping means is a laid, substantially fixed delivery line, and from the outlet port, the delivery line is led up to a transfer point fixed to the tower.

33. Boring appliance according to claim 18, wherein the means for preventing premature hardening of the concrete in the delivery line comprises sun protection plates fitted to the delivery line.

34. Boring appliance according to claim 18, wherein the means for preventing premature hardening of the concrete in the delivery line comprises separate cooling devices fitted to the delivery line.

* * * * *